United States Patent [19]

Audeh

[11] 4,379,045

[45] Apr. 5, 1983

[54] CO-PROCESSING OF RESIDUAL OIL AND COAL

[75] Inventor: Costandi A. Audeh, Princeton, N.J.

[73] Assignee: Mobil Oil Corporation, New York, N.Y.

[21] Appl. No.: 261,075

[22] Filed: May 6, 1981

[51] Int. Cl.[3] ..... C10G 1/08; C10G 11/00; C10G 9/00; C10C 3/00

[52] U.S. Cl. ..... 208/9; 208/113; 208/100; 208/309

[58] Field of Search ..... 208/9, 100, 309, 113

[56] References Cited

U.S. PATENT DOCUMENTS

| | | | |
|---|---|---|---|
| 2,377,728 | 6/1945 | Thomas | 208/10 |
| 3,687,838 | 8/1972 | Seitzer | 208/9 |
| 3,870,621 | 3/1975 | Arnold | 208/11 R |
| 3,925,195 | 12/1975 | Scherzer et al. | 208/120 |
| 4,054,504 | 10/1977 | Chervenok | 208/10 |
| 4,108,758 | 8/1978 | Schoenvogel | 208/10 X |
| 4,111,787 | 9/1978 | Aldridge et al. | 208/10 |
| 4,132,627 | 1/1979 | Lear | 208/10 |
| 4,152,244 | 5/1979 | Raichle et al. | 208/10 X |
| 4,169,038 | 9/1979 | Metrailer et al. | 208/10 |
| 4,269,696 | 5/1981 | Metrailer | 208/120 |
| 4,278,529 | 7/1981 | Gearhart | 208/309 |
| 4,289,606 | 9/1981 | Gladrow et al. | 208/120 |

FOREIGN PATENT DOCUMENTS

| | | | |
|---|---|---|---|
| 2073353 | 4/1974 | U.S.S.R. | 208/9 |

OTHER PUBLICATIONS

Moschopedis et al., "The Use of Heavy Oils to Upgrade Coal", 30th Canadian Chemical Engineering Conference, Oct. 1980.

*Primary Examiner*—Delbert E. Gantz
*Assistant Examiner*—William G. Wright
*Attorney, Agent, or Firm*—Charles A. Huggett; Michael G. Gilman; L. G. Wise

[57] ABSTRACT

Visbreaking a mixture of petroleum residuum, coal and catalytic cracking catalyst under conditions severe enough to effect conversion but not so severe as to produce substantial quantities of coke produces a range of products including gaseous olefins and gasoline distillate. The solids recovered from the visbreaking operation can be processed to produce a synthesis gas of carbon monoxide and hydrogen.

3 Claims, No Drawings

CO-PROCESSING OF RESIDUAL OIL AND COAL

BACKGROUND OF THE INVENTION

1. Field of the Invention

This invention relates to the co-processing of residual oil and coal. More particularly, it relates to a process for the production of light distillates and fuel oil from residual oil and coal. This invention especially relates to the processing of residual oil and coal in the presence of a catalytic cracking catalyst.

2. Description of the Prior Art

Petroleum has been utilized heretofore as a major source of energy, particularly because of its relatively low cost and its availability in liquid form which permitted ease of transportation and ultimate use. This relatively clean burning energy source presents a minimum of disposal problems and thus has found wide spread use throughout the world. Natural gas is a fuel which has also been utilized as a particularly useful form of energy but its gaseous form has limited its transportability and hence it has not found the world wide use that petroleum has. Recent economic and political developments have led to increasingly high purchase prices for both of these products. In addition, the high cost of energy from petroleum and natural gas as well as their potentially limited availability has led to investigation of alternate sources of energy such as oil shale and tar sands. There has recently been an increased interest in coal as a major energy source. Reserves of coal are far greater than the known reserves of all other mineral fuels (petroleum, natural gas, oil shale and tar sands) combined. Since coal is a solid fuel and when burned in this form requires disposition of residual ash, its use as a major energy source is not as desirable as either petroleum or natural gas. However, processes have been and are being developed to convert coal into both liquified and gaseous fuels which will increase its desirability as a useful energy source. Although these conversion processes have not proven economical heretofore, the increasing cost of conventional energy sources make these conversion techniques more and more attractive.

Coal liquefication and gasification processes developed heretofore utilize a wide variety of techniques including thermal and catalytic conversion, non-hydrogenative and hydrogenative conversion and various combinations thereof. Patent art in this area includes the following:

U.S. Pat. No. 3,870,621 of Arnold, et al. discloses contacting a liquid phase of a petroleum residual oil with finely divided coal in a fixed or moving bed at a temperature in the range of 700°–900° F. to produce cracked products from the oil and hydrocarbons from the coal which are fractionated to produce a heavy recycle stream and lighter products. The solid char recovered as a product from the contacting zone can find use as a high quality solid fuel.

U.S. Pat. No. 4,108,758 of Schoennagel, et al. discloses a process for obtaining liquid fuels from coal which involves the solubilizing of coal in a fluid catalytic cracked residual oil to form a solvated coal solution phase and an ash solid phase. The two phase admixture is fluid catalytic cracked to produce a hydrocarbon phase and a catalyst-ash solids phase. The catalyst-ash solids phase is treated in a catalyst regeneration zone whereby entrained ash solids are removed from the flue gas effluent from the catalyst regenerator. The solvated coal admixture is mixed with gas oil and introduced into a conventional fluid catalytic cracking unit.

U.S. Pat. No. 4,152,244 of Raichle, et al. relates to the production of hydrocarbon oils by the hydrocracking of finely ground coal. The coal is slurried, optionally with a catalyst, in a mixture of middle or heavy oil recycled from the recovery section of the process. The slurry is heated together with hydrogen at elevated temperature and pressure to produce gas, gasoline, middle distillates and heavy oil. The solids from the bottoms product are recovered for conversion in a gasifier to produce synthesis gas.

U.S. Pat. No. 4,169,038 of Metrailer et al. discloses a combination process of hydroconversion, fluid coking and gasification. A liquid-comprising carbonaceous charge stock, which may be a slurry of coal in petroleum residua, is subject to hydroconversion in the presence of a catalyst of solid carbonaceous fines recovered from the downstream gasifier. A heavy oil fraction, recovered from the hydrocarbonaceous oil product of the hydroconversion, is subject to fluid coking to form additional coke which in turn is introduced into a gasification zone with steam and a molecular-oxygen containing gas to produce a synthesis gas containing hydrogen. Solid carbonaceous fines are recovered from the gasifier and recycled to the hydroconversion zone for use therein as the catalyst.

Other prior art processes disclose catalytic hydroconversion of coal admixed with oil. These processes include those disclosed in U.S. Pat. Nos. 2,377,728 of Thomas; 4,054,504 of Chervenak, et al.; 4,111,787 of Aldridge, et al. and 4,132,627 of Leas, as well as in "The Use of Heavy Oils to Upgrade Coal", by Moschopedis, et al. presented at the 30th Canadian Chemical Engineering Conference in October, 1980.

Although most of the prior art coal conversion processes employ hydrogen, several of those discussed herein, U.S. Pat. Nos. 3,870,621 of Arnold, et al. and 4,108,758 of Schoennagel, et al. do not employ hydrogen in the conversion step. However, in Arnold, et al. the heavy feed is essentially catalytically cracked, utilizing solid coal particles as the catalyst under temperature conditions of 700°–900° F., a pressure between 10 and 100 psig and a space velocity of 0.1 to 3.0 lbs. of oil per hour per pound of coal. The liquid product is fractionated to a light fraction recovered as the product with the higher boiling fraction recycled to the contacting zone. A solid char is withdrawn from the bed of coal and is utilized as solid fuel. In Schoennagel, et al. a mixture of residual oil and coal is admixed with gas oil and introduced into a conventional catalytic cracking reactor to produce the conventional liquid products obtained in catalytic cracking. The ash from the coal is recovered in the gaseous effluent from the regenerator vessel.

It is an object of this invention to provide a process for converting mixtures of petroleum residua and coal to useful products under relatively mild process conditions.

It is another object of this invention to provide a process for producing normally gaseous hydrocarbons, atmospheric distillates and vacuum distillates from residual oils co-processed with coal.

It is a further object of this invention to convert petroleum residual oil and coal to products including light olefinic hydrocarbons, light distillate in the gasoline boiling range, light and heavy gas oils, residual oil having reduced metals content and low or intermediate BTU fuel gas.

SUMMARY OF THE INVENTION

In accordance with the present invention, it has been found that coal and petroleum residual oil can be co-processed in the presence of a catalytic cracking catalyst under conditions which are severe enough to reduce the viscosity of the residual oil but without significant conversion to coke. More particularly, it has been found that a mixture of coal and petroleum residuum can be subjected to visbreaking conditions in the presence of a catalytic cracking catalyst without the significant production of coke to yield light olefinic hydrocarbons, distillate boiling in the gasoline boiling range, light and heavy gas oils, a bottoms product having a reduced metals content and a solid phase of cracking catalyst, coal ash and coal solids which can be converted to a synthesis gas.

The process of this invention is described as a process for the production of gaseous olefins and light liquid distillates from residual oil co-processed with coal which comprises:

(a) heating a mixture of residual oil, pulverized coal and a cracking catalyst under conditions effective to reduce the viscosity of the residual oil without the substantial formation of coke, the amount of said cracking catalyst being effective to provide olefinic hydrocarbons, a distillate in the gasoline boiling range, light gas oil and heavy gas oil, (b) separating the reaction mixture of step (a) into a gaseous phase, a liquid phase and a solid phase comprising cracking catalyst, coal ash, and coal solids, and (c) fractionally distilling the gaseous and liquid phases of step (b) to provide a light olefinic hydrocarbon fraction, a distillate in the gaseoline boiling range, light gas oil, heavy gas oil, and a bottoms fraction.

In optional embodiments the solid phase of step (b) can be gasified to provide a synthesis gas comprising hydrogen. In another embodiment the bottoms fraction from step (a) may be subjected to solvent deasphalting to provide a deasphalted bottoms fraction.

DESCRIPTION OF THE PREFERRED EMBODIMENTS

The present invention relates to a process for visbreaking a mixture of residuum and coal in the presence of a catalytic cracking catalyst. Briefly, this invention may be described as subjecting an admixture of coal, residuum and a cracking catalyst to visbreaking conditions severe enough to reduce the viscosity of the residuum but not severe enough to convert substantial quantities of the admixture to coke. Not only does the process result in the reduction of the viscosity of the residuum but the residuum solubilizes some of the coal, the coal reduces the metals content of the visbroken residua and the cracking catalyst promotes the production of significant quantities of olefinic hydrocarbons and gasoline distillate. Following the visbreaking process the reaction mixture is separated into a liquid phase and a solid phase. The liquid phase can conveniently be fractionally distilled to yield a gaseous stream of olefinic hydrocarbons, a distillate in the gasoline boiling range and a bottoms fraction which has a reduced metal content over that of the residual oil feed. The solids recovered contain the cracking catalyst, coal ash and any remaining coal solids. This solid phase can be conveniently sent to a gasifier without further processing to produce synthesis gas comprising CO and hydrogen. Further, the bottoms liquid fraction can be subjected to solvent deasphalting to produce a desirable solvent deasphalted bottoms fraction.

In practicing of the process of this invention mixtures of coal and petroleum residual oil are employed. As used herein, the term "coal" is used to designate a normally solid carbonaceous material including all types of coal, such as bituminous coal, semibituminous coal, subbituminous coal, lignite, peat and mixtures thereof. The petroleum residual oil (also referred to as residua herein) employed in the process of this invention is a usually non-hydrogen donor oil, that is, an oil having less than 0.8 weight percent donatable hydrogen under the visbreaking conditions employed in this invention in this process. Thus, the petroleum residua used in this invention includes heavy mineral oils, whole or topped crude oils, atmospheric tower residua, i.e., boiling above about 700° F. and vacuum tower residua, i.e., boiling above about 1000° F., and bottoms fractions from catalytic cracking units and other refinery operations. Asphalts, raw creosote oils, high-boiling crude oils, tars, bitumens, tar sand oils, shale oils and the like may also be employed. Such oils will normally contain constituents boiling above about 700° F. and will have API gravities in the range of about −5° to about +35° API and Conradson carbon values of about 1% or more. High boiling residual petroleum fractions having initial boiling points above about 700° F. are generally preferred feedstocks for use in the process of this invention.

In accordance with the practice of this invention, the mixture of coal and petroleum residuum is subjected to visbreaking conditions in the presence of a catalytic cracking catalyst. The catalyst so employed can be any catalytically active substance which serves to catalyze reactions involving cracking of heavier hydrocarbon molecules into lighter hydrocarbon molecules. Catalysts of this type include manganese nodules, bauxite, alumina, silica-alumina, magnesia-silica, alumina-zirconia-silica, boria-alumina, attapulgus clay, and natural and synthetic zeolites. Non-limiting examples of zeolitic materials useful in this invention include the synthetic zeolites X, Y, ZSM-5, ZSM-11, ZSM-12, ZDM-23, ZSM-35, ZSM-38 and others, and naturally occurring zeolites, such as erionite, faujasite, mordenite, levynite, dachiarite, analcite, paulingite, noselite, phillipsite, chabazite, leucite, ferrierite and others.

The major conventional cracking catalysts presently in use generally comprise a crystalline zeolite in a suitable matrix. Representative crystalline zeolite constitutents of conventional cracking catalysts include zeolite A (U.S. Pat. No. 2,882,243), zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), synethetic mordenite and dealuminized synthetic mordenite, to name a few, as well as naturally occurring zeolites, including chabazite, faujasite, mordenite, and the like. Preferred crystalline zeolites include the synthetic zeolites X and Y, with particular preference being accorded zeolite Y.

In general, the crystalline zeolites are ordinarily ion exchanged either separately or in the final catalyst form with a desired cation to replace the alkali metal present in the zeolite as found naturally or as synthetically prepared. The ion exchange treatment reduces the alkali metal content of the final catalyst to less than about 1.5 weight percent and preferably less than about 0.5 weight percent. The purpose of ion exchange is to substantially remove alkali metal cations which are known to be deleterious to cracking, as well as to introduce particularly desired catalytic activity by means of the various cations used in the exchange medium. For the cracking operation described herein, preferred cations are hydrogen, ammonium, rare earth metals and mixtures thereof, with particular preference being accorded rare earth metals. Ion exchange is suitably accomplished by conventional contact of the zeolite with a suitable salt solution of the desired cation such as, for example, the sulfate, chloride or nitrate.

It is preferred to have the crystalline zeolite of the cracking catalyst in a suitable matrix, since this catalyst form is generally characterized by a high resistance to attrition, high activity and exceptional steam stability. Such catalysts are readily prepared by dispersing the crystalline zeolite in a suitable siliceous sol and gelling the sol by various means. The inorganic oxide which serves as the matrix in which the above crystalline zeolite is distributed includes silica gel or a cogel of silica and a suitable metal oxide. Representative cogels include silica-alumina, silica-magnesia, silica-zirconia, silica-thoria, silica-beryllia, silica-titania, as well as ternary combinations such as silica-alumina-magnesia, silica-alumina-zirconia and silica-magnesia-zirconia. Preferred cogels include silica-alumina, silica-zirconia or silica-alumina-zirconia. The above gels and cogels will generally comprise a major proportion of silica and a minor proportion of the other aforementioned oxide or oxides. Thus, the silica content of the siliceous gel or cogel matrix will generally fall within the range of 55 to 100 weight percent, preferably 60 to 95 weight percent, and the other metal oxide or oxides content will generally be within the range of 0 to 45 weight percent and preferably 5 to 40 weight percent. In addition to the above, the matrix may also comprise natural or synthetic clays, such as kaolin type clays, montmorillonite, bentonite or halloysite. These clays may be used either alone or in combination with silica or any of the above specified cogels in matrix formulation.

Where a matrix is used, the content of crystalline zeolite, i.e. the amount of the zeolite component is generally between 5 and about 50 weight percent. Ion exchange of the zeolite to replace its initial alkali metal content can be accomplished either prior to or subsequent to incorporation of the zeolite into the matrix.

The above compositions may be readily processed so as to provide cracking catalysts by spray drying the composite to form microspheroidal particles of suitable size. Alternatively, the composition may be adjusted to suitable concentration and temperature to form bead type catalyst particles. The catalyst may also be used in various other forms such as those obtained by tabletting, balling or extruding.

While fresh cracking catalysts of the type hereinbefore described may be employed in the present process, the catalyst used can also be one which has previously been employed in other refinery processes. Thus, it is contemplated that the catalyst utilized in the process of the present invention will be one which is cheap and disposable, e.g., an equilibrium catalyst, a coked but regenerable catalyst as well as a spent catalyst which would be a candidate for disposal or relatively expensive regeneration. Examples of catalysts of this type include the conventional fluid catalytic cracking (FCC) catalysts, such as rare earth exchanged zeolite Y (REY).

Visbreaking is a well-known petroleum refining process in which reduced crudes are pyrolized or cracked under comparatively mild conditions without significant coke production to provide products having lower viscosities and pour points thus reducing the amount of less viscous and more valuable blending stocks required to make the residual stocks useful as fuel oils. Typical visbreaking process conditions which are employed in the process of this invention include an operating temperature of about 800° to about 975° F. and a pressure of about 50 to about 1,000 psig. The process is conventionally practiced by passing the feed through a heater and thence through a reaction zone or chamber maintained at these conditions. In general, visbreaking process conditions conventionally employed in the art are likewise employed in the process of this invention.

In practicing the process of this invention, admixtures of oil, coal and catalyst are subjected to visbreaking. This visbreaking feedstock may be prepared by any conventional means readily available. For example, the required quantities of oil, coal and cracking catalyst may be added to an agitated vessel, then passed through a slurry pump for transfer to the visbreaking unit. In a similar fashion the residual oil can be pumped through a pipeline to which metered quantities of coal and catalyst are injected. In preparing the visbreaker feed, the weight ratio of oil to coal should be between about 1.0 to about 20, preferably about 1.5 to about 4.0. The quantity of cracking catalyst should be sufficient to provide the required conversion to olefinic gases and light distillates. With zeolitic-type cracking catalyst, catalyst concentrations of about 0.1 to about 15 weight percent, preferably about 5 to about 10 weight percent of the coal-oil mixture have proven useful. Those skilled in the art can appreciate that higher or lower concentrations of cracking catalyst can be employed to obtain the desired product slate from this process.

The admixture of residuum, coal and catalyst are subjected to conventional visbreaking conditions in a fashion which causes a reduction in the viscosity of the residuum without the substantial production conversion to coke. Further, the conditions are so selected that the reaction mixture passing from the visbreaker contains significant quantities of olefinic gases and gasoline distillate. Thus, in addition to the operating temperatures and pressures described hereinbefore, a LHSV of 0.5 to about 15, preferably about 6 to about 11, V/V/hr is maintained in the visbreaker. Following the visbreaking of the feed stock, the reaction mixture is passed through a separator vessel to separate the gaseous and liquid products from the solids phase. Such separation means as decanting and/or filtering may be employed here. The liquid and gases recovered are then subjected to fractional distillation to recover the desired products which include a gaseous olefinic hydrocarbon stream, a gasoline distillate stream and bottoms fraction. Where desired, additional side stream cuts, such as light gas oil and heavy gas oil, can be taken to provide distillate products heavier than gasoline. The bottoms fraction recovered may be utilized as fuel or subjected to further processing to provide desired products.

In one embodiment, the bottoms fractions is subjected to solvent deasphalting to provide a deasphalted petroleum fraction so as to facilitate the downstream processing of this bottoms cut. The presence of asphalt is detrimental to the bottoms fractions recovered from the visbroken feed since asphalts readily oxidize to form carbon and sludge which are undesirable in such finished products as lubricating oils. Further, asphalts must be excluded from feedstocks to be subjected to catalytic conversion, such as catalytic cracking and the like, where their presence would result in high coke levels which are detrimental to catalyst activity.

The solid phase recovered from the visbreaker consists of catalytic cracking catalyst, coal ash and coal solids. Since this solid phase has significant heating value it may be utilized as fuel. Alternatively, it may be passed to a gasifier for conversion, by conventionally known means, to synthesis gas consisting of carbon monoxide and hydrogen. These solids may be gasified in a generator, suitably by partial oxidation in the presence of steam to provide a mixture of carbon oxides and hydrogen which can be subsequently treated to provide low or intermediate BTU fuel gas or converted to an essentially pure stream of hydrogen. The gasifier is operated at a temperature ranging from about 1,200° to about 2,000° F. and a pressure of about 5 to about 150 psig to produce a hydrogen-containing gas and a carbonaceous solid residue. This solid residue contains essentially all of the added catalyst as well as the ash from the coal. Where the coal contains little or no ash the catalyst may be recovered and reused in the process. However, where the coal contains significant quantities of ash the residue will be discarded. Thus when processing a high-ash coal, it is convenient to utilize a spent or otherwise disposable catalytic cracking catalyst.

The partial oxidation process employed in the gasifier produces a low BTU value gas stream consisting essentially of carbon monoxide and hydrogen diluted with carbon dioxide and nitrogen. Where a medium BTU gas stream is desired, pure oxygen instead of air can be utilized in the partial oxidation of the solids. A high BTU gas, generally referred to as SNG, may be obtained from the medium BTU gas stream by a process known as methanation which is a low temperature catalytic process which combines carbon monoxide and hydrogen in the synthesis gas to form methane and water. The processes for producing low, medium and high BTU gas are practiced commercially today, are well-known to those skilled in the art and, therefore, need not be described herein.

What is claimed is:

1. A process for the production of gaseous olefins and light liquid distillate from residual oil co-processed with coal which comprises:

(a) heating a mixture of residual oil, pulverized coal and a rare earth exchanged zeolite Y cracking catalyst under conditions effective to reduce the viscosity of the residual oil without the substantial formation of coke, the amount of said cracking catalyst being effective to provide olefinic hydrocarbons, a distillate in the gasoline boiling range, light gas oil, and heavy gas oil, (b) separating the reaction mixture of step (a) into a gaseous phase, a liquid phase and a solid phase comprising cracking catalyst, coal ash and coal solids, and (c) fractionally distilling the gaseous and liquid phase of step (b) to provide a light olefinic hydrocarbon fraction, a distillate in the gasoline boiling range, light gas oil, heavy gas oil, and a bottoms fraction.

2. A process according to claim 1 including the following additional step:

(d) gasifying the solid phase of step (b) to provide a synthesis gas comprising hydrogen.

3. A process according to claim 1 wherein the weight ratio of oil to coal is about 1 to about 20 and the concentration of catalyst is about 0.1 to about 15 weight percent of the mixture of oil and coal.

* * * * *